United States Patent [19]

Babu

[11] 4,235,630

[45] Nov. 25, 1980

[54] WEAR-RESISTANT MOLYBDENUM-IRON BORIDE ALLOY AND METHOD OF MAKING SAME

[75] Inventor: B. Naga P. Babu, Peoria, Ill.

[73] Assignee: Caterpillar Tractor Co., Peoria, Ill.

[21] Appl. No.: 939,524

[22] Filed: Sep. 5, 1978

[51] Int. Cl.[3] ..... B22F 3/00

[52] U.S. Cl. ..... 75/244; 75/123 B; 75/123 J; 75/176; 75/203; 75/204

[58] Field of Search ..... 75/123 B, 123 J, 176, 75/203, 204, 238, 244

[56] References Cited

U.S. PATENT DOCUMENTS

| | | | |
|---|---|---|---|
| 1,493,191 | 5/1924 | deGolyer | 75/126 B |
| 3,258,817 | 7/1966 | Smiley | 164/52 |
| 3,720,990 | 3/1973 | Larsen | 75/244 |
| 3,937,619 | 2/1976 | Clougherty | 75/233 |
| 3,954,419 | 5/1976 | Kaufman | 75/244 |
| 3,970,445 | 7/1976 | Gale et al. | 75/0.5 B |
| 3,999,952 | 12/1976 | Kondo et al. | 75/244 |
| 4,011,051 | 3/1977 | Helton et al. | 75/244 |
| 4,133,679 | 1/1979 | Ray | 75/176 |

OTHER PUBLICATIONS

Kolomysteu et al., *Poroshkovaya Metallurgiya,* 8–66.

Metcalfe, "Cemented Borides for Tools Materials", 3–56.

Steinitz et al., "New Ternary Boride Compounds", *Powder Metallurgy,* Bull. 2–53.

Haschke, H. et al., "Untersuchungen in den Dreistoffen: {Mo,W}-{Fe,Co,Ni}-B, in Monat. fur Chemie", 97(5): 1459–1468, 1966.

*Primary Examiner*—Brooks H. Hunt

*Attorney, Agent, or Firm*—Charles E. Lanchantin, Jr.

[57] ABSTRACT

A wear-resistant, molybdenum-iron boride alloy (10) has a microstructure of a primary boride phase (12) and a matrix phase (14). The primary boride phase (12) comprises molybdenum alloyed with iron and boron, and the matrix phase (14) comprises one of iron-boron in iron and iron-molybdenum in iron and has a hardness less than that of the primary boride phase (12). The subject alloy finds particular utility in a composite material on a ground-engaging tool such as a cutting edge or ripper tooth, and can also be used for wear-resistant coatings, machine tool inserts, bearings, and the like.

31 Claims, 6 Drawing Figures

EXAMPLE I - 77Wt.%Mo + 23Wt.%FeB

EXAMPLE II - 68Wt.%Mo + 32Wt.%FeB

EXAMPLE III – 60Wt.%Mo + 40Wt.%FeB

EXAMPLE IV – 50Wt.%Mo + 50Wt.%FeB

EXAMPLE V – 40Wt.%Mo + 60Wt.%FeB

WEAR-RESISTANT MOLYBDENUM-IRON BORIDE ALLOY AND METHOD OF MAKING SAME

TECHNICAL FIELD

This invention relates to a wear-resistant and abrasive-resistant boride alloy and method of making same, and particularly to such an alloy suitable for use in a ground-engaging tool, wear-resistant coating, machine tool insert, bearing, and the like.

BACKGROUND ART

Ground-engaging tools such as ripper teeth, earth-moving buckets, and cutting edges for various blades are often subject to a rapid rate of wear due to continual contact of the tool with rock, sand, and earth. Upon experiencing a preselected degree of wear, the worn tool is typically removed from the implement and a new tool installed, or alternately the tool is rebuilt by adding hardfacing weld material to the critically worn regions thereof. Because this repetitive and expensive maintenance is required, the industry has continued to search for and develop tools having the lowest possible hourly cost and/or an extended service life to minimize loss of machine downtime.

One approach to these problems is to utilize carbide tool materials containing such elements as tungsten, cobalt, and tantalum for increased wear-resistance. Tungsten carbide tools, for example, have been widely adopted because of their wear-resistance for metal cutting and manufacturing purposes. Unfortunately, these elements are either strategic or scarce, so that the carbide materials are price sensitive.

Another recently developed tool material competing with cobalt-bonded tungsten carbide includes the carbides of titanium and chromium with a nickel base alloy as a binder material. While such a composite material family also offers several advantageous properties, the binder or matrix phase thereof has insufficient ductility so that it is not desirable for use with tools that are subjected to frequent shocks. Representative of this category is U.S. Pat. No. 3,258,817 issued July 5, 1966 to W. D. Smiley.

Another particularly promising family of materials is represented by cemented borides. Chromium borides, for example, have been under development for some time as is indicated by U.S. Pat. No. 1,493,191 which issued May 6, 1924 to A. G. DeGolyer, and more recently by U.S. Pat. No. 3,970,445 which issued July 20, 1976 to P. L. Gale, et al. Other boride materials have been considered as is evidenced by: U.S. Pat. No. 3,937,619 which issued Feb. 10, 1976 to E. V. Clougherty on use of titanium, zirconium, and hafnium with boron; U.S. Pat. No. 3,954,419 which issued May 4, 1976 to L. P. Kaufman on titanium diboride mining tools; and U.S. Pat. No. 3,999,952 which issued Dec. 28, 1976 to Y. Kondo, et al on a sintered alloy of multiple boride containing iron. Moreover, boride compounds are discussed in the following references: article by R. Steinitz and I. Binder entitled "New Ternary Boride Compounds" in the February 1953 issue of *Powder Metallurgy Bulletin;* paper by A. G. Metcalfe entitled "Cemented Borides for Tool Materials" and presented at the Mar. 19–23, 1956 meeting of the American Society of Tool Engineers; and an article by P. T. Kolomytsev and N. V. Moskaleva entitled "Phase Composition and Some Properties of Alloys of the System Molybdenum-Nickel-Boron" and published in *Poroshkovaya Metallurgiya,* No. 8 (44), pages 86–92, August 1966. These borides contain strategic, price-sensitive elements such as nickel and chromium and/or do not necessarily offer the best wear resistance.

The present invention is directed to overcoming one or more of the problems as set forth above.

DISCLOSURE OF INVENTION

In one aspect of the present invention, a wear-resistant, molybdenum-iron boride alloy is provided having a microstructure of a primary boride phase of molybdenum alloyed with iron and boron, and a matrix phase of one of iron-boron in iron and iron-molybdenum in iron.

In another aspect of the present invention, the molybdenum-iron boride alloy is made by mixing a plurality of finely divided ferroboron particles or powder with a plurality of finely divided molybdenum particles or powder at a preselected ratio by weight, pressing the mix into an article, sintering the article at a temperature sufficient for controlled formation of a liquid phase, holding the temperature for a preselected amount of time sufficient to assure a substantially complete reaction and substantially complete densification, and cooling the article to provide a primary boride phase in a matrix phase.

Advantageously, the instant invention provides a relatively hard primary boride phase of the form $Mo_2FeB_2$ in a tough matrix phase, and the volumetric percent of the primary boride (the proportion of molybdenum, iron, and boron) is so chosen as to optimize the microstructure for maximum wear resistance. For example, the interparticle spacing of the primary boride particles is advantageously selected to be relatively uniform and small, and the shape of the primary boride particles is preferably selected to be of granular and/or equiaxed grain structure. By the term "equiaxed grain structure" it is meant that the primary boride particles have corners close to 90° and generally greater than 60°. The result of this construction is to provide an molybdenum-iron boride alloy having an average hardness level above 1550 $Kg/mm^2$ Knoop, preferably above about 1600 $Kg/mm^2$ Knoop, using a load of 500 grams.

BEST MODE FOR CARRYING OUT THE INVENTION

The alloy of the present invention, characterized by high anti-wear properties, has preselected proportions of molybdenum and boron, and the remainder being substantially iron. Preferably, because of its commercial availability, ferroboron at about 25 Wt.% boron is mixed with molybdenum and compressed in a die, and subsequently subjected to liquid phase reactive sintering to make the alloy. Preferably, also this liquid phase sintering takes place in a substantially inert atmosphere. The molybdenum-iron boride alloy of the present invention can be crushed into a plurality of wear-resistant particles and subsequently bound together by employing a suitable matrix to make a novel and long lasting composite wear material for a ground engaging tool, machine tool insert, or the like.

Figure 1:
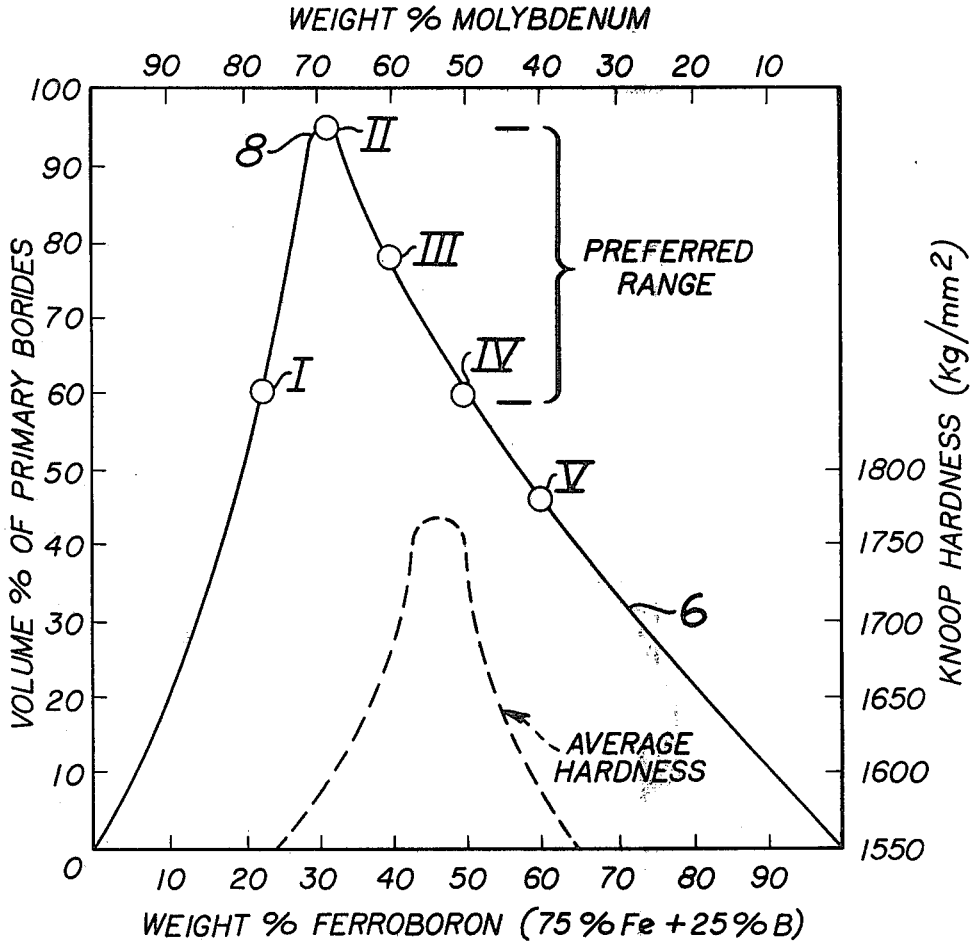
FIG. 1 is a diagrammatic graph showing the preferred composition of the wear-resistant molybdenum-iron boride alloy of the present invention in terms of the weight proportions of molybdenum and ferroboron (25 Wt.% B) plotted against the volumetric percent of primary borides. Also shown is the average Knoop hardness level readings in $Kg/mm^2$ using a 500 gram load for the various compositions as indicated by the Knoop hardness values set forth along the right vertical axis.

The diagram of FIG. 1 resulted from a phase analysis of the pseudo-binary molybdenum-ferroboron (25 Wt.% B) system. This analysis was substantiated by preparing five alloys, hereinafter identified as Example Nos. I—V, with the ferroboron ranging from 23 to 60 Wt.%, and then analyzing the five alloys for microstructure and hardness. The volume percent of the primary borides in the five alloys was measured by lineal analysis, and an excellent correlation between the predicted volume percent and the actual measured volume percent was noted. Also X-ray diffraction analysis of the molybdenum-iron boride alloy of the present invention has shown the harder primary boride phase to be of the chemical form $Mo_2FeB_2$. The tough matrix or binding phase, on the other hand, is generally either of the form Fe-Mo or Fe-B depending on the selected composition.

Because the higher boron eutectic in the binary boron-iron system exists at a 25.6 Wt.% of boron, I recommend a range for the starter ferroboron of about 20 to 30 Wt.% boron. The eutectic has a melting point of about 1502° C. (2735" F.) so that such 20 to 30 Wt.% boron range establishes about a 100° C. (180" F.) melting range. Ideally, the eutectic composition of 25.6 Wt.% B is preferred because the melting temperature range is minimized. The low temperature also minimizes grain growth following the formation of the primary boride phase. The volume percent primary boride composition curve 6 shown in FIG. 1 is based on 25 Wt.% boron in the ferroboron constituent.

The matrix phase is preferably limited to a broad range of about 5 to 40% by volume, or alternately the primary boride phase is preferably limited to a broad range of about 95 to 60% by volume as is indicated on the graph of FIG. 1. A minimum matrix phase of 5 Vol.%, and more desirably 10 Vol.%, is believed required to prevent the formation of continuous networks of the primary borides. A matrix phase in excess of 40 Vol.% is believed detrimental because the matrix phase is relatively soft in comparison with the hard primary phase and the matrix phase wears out and leaves the primary phase unsupported. In the unsupported condition, the particles or grains of the primary boride phase can break off and result in a marked decrease in overall wear resistance. Thus, the mean free path between any two boride particles should be of a minimum amount to block the otherwise advanced erosion of the matrix phase, and to prevent the primary boride particles from standing up in relief and fracturing. Because of such considerations, most desirably the matrix phase should be in the range of about 10 to 30 Vol.%.

The composition of the matrix phase in the boride alloy of the present invention changes considerably at 32 Wt.% ferroboron, or at the peak 8 of the composition curve 6 shown in FIG. 1. For compositions with a ferroboron content exceeding 32 Wt.%, the matrix phase is primarily a eutectic consisting mainly of iron-boron, $Fe_2B$ or FeB, in iron. For compositions with a ferroboron content less than 32 Wt.% the matrix phase is relatively free of boron and contains mainly an intermetallic compound of iron-molybdenum in iron, and thus is softer. Therefore, the preferred composition range is that which produces the harder matrix, or is that range of composition generally located to the right of the peak 8 of FIG. 1.

The aforementioned general considerations are confirmed by an examination of the following specific examples of the molybdenum-iron boride alloy 10 of the present invention, identified as Examples I–V on the diagram of FIG. 1 and corresponding to photomicrograph FIG. Nos. 2–6 respectively.

EXAMPLE I

Figure 2:
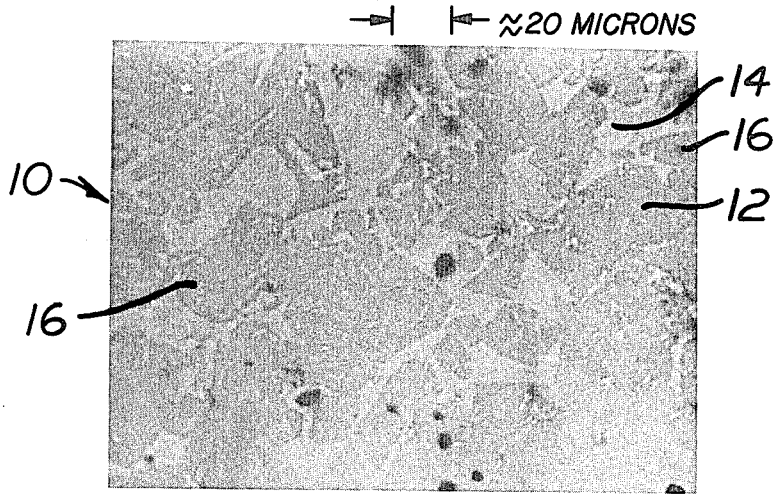
FIG. 2 is a photomicrograph showing the microstructure of the sintered molybdenum-iron boride alloy in Example 1 of the present invention at a magnification as indicated thereon.

FIG. 2 is a photomicrograph of the Example I composition showing a morphology of a primary boride phase 12 and a matrix phase 14. The Example I article was made by mixing or blending a plurality of finely divided ferroboron particles of −100 mesh sieve size (less than 152 microns) and a plurality of finely divided molybdenum particles of −300 mesh sieve size (less than 53 microns) and forming a mix at a preselected ratio by weight. In Example I the mix was 77 Wt.% molybdenum 23 Wt.% of the preferred ferroboron constituent, i.e., with 25 Wt.% boron. This mix was compressed in a die at a preselected pressure level of about 345 MPa (50 Ksi) into an article of preselected shape in order to obtain a density level of about 65%. The shape of the cold pressed specimens was rectangular, being generally about 25 mm×76 mm×9.5 mm. This article was then sintered in a furnace at a preselected temperature sufficient for controlled formation of a liquid phase. In the instant example, the article was sintered in an argon gas atmosphere at a pressure of 500 microns of mercury. Such preselected temperature, about 1600° C. (2900° F.), was held or maintained for a preselected period of time of about ten minutes to assure a substantially complete liquid reaction and a density level of about 98%.

The substantially completely densified article was subsequently cooled by the introduction of an inert gas at substantially ambient temperature to provide an alloy having the primary boride phase 12 in the matrix phase 14. Example I had about 60 Vol.% of primary borides, and this relationship can be visualized by reference to FIG. 2. In FIG. 2 note that the grains 16 of the primary boride phase 12 have shapes that are desirably equiaxed, with the average grain size being generally in a range of about 20 to 50 microns and the interparticle spacing being generally in a range of about 0 to 20 microns. Knoop hardness readings using a 500 gram load varied between 1520 and 1650 $Kg/mm^2$, with an average hardness of about 1540 $Kg/mm^2$.

EXAMPLE II

Figure 3:
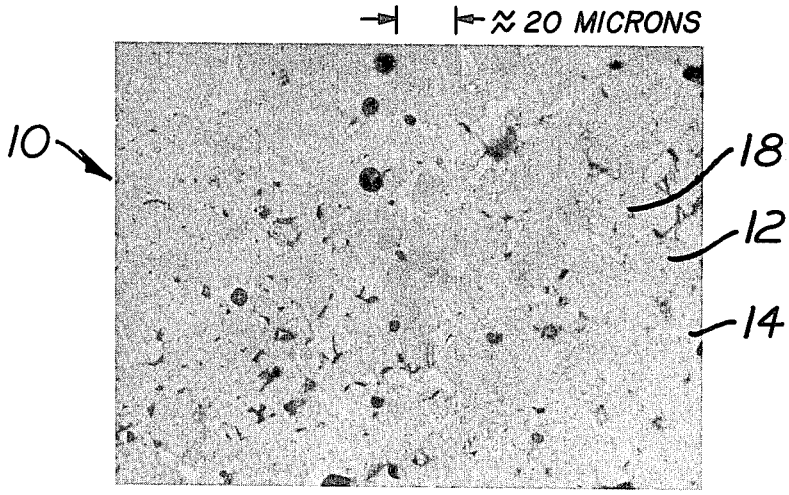
FIG. 3 is a photomicrograph similar to FIG. 2 of the alloy in Example II of the present invention.

The Example II article shown in FIG. 3 was made in the same manner as Example I discussed above, only the mix was 68 Wt.% molybdenum and 32 Wt.% of the preferred ferroboron constituent. This resulted in about 95 Vol.% of primary borides and an observable change in the morphology as may be noted by reference to FIG. 3. I consider the relatively large amount of the primary boride phase 12 to be undesirable, since this results in the formation of continuous hard phase networks. The matrix phase 14 is such a small proportion that it is insufficient to keep the individual equiaxed boride grains 18 discrete. In other words, the boride grains tend to cluster and become more susceptible to brittle failure. The average size of the grains 18 in Example II was generally in a range of about 15 to 30 microns, and the interparticle spacing was generally in a range of about 0 to 10 microns. Knoop hardness readings between 1459 and 1680 Kg/mm$^2$ were obtained at a 500 gram load, with an average reading of about 1600 Kg/mm$^2$.

EXAMPLE III

Figure 4:
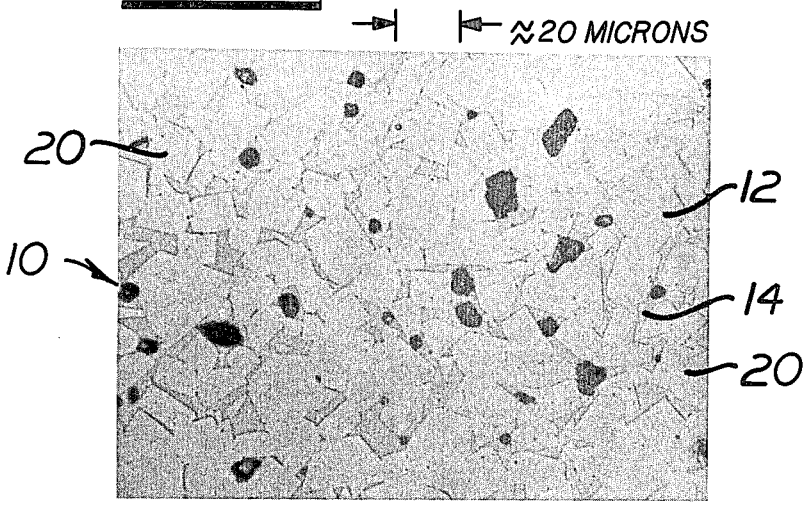
FIG. 4 is a photomicrograph similar to FIGS. 2 and 3 of the alloy in Example III of the present invention.

The Example III construction shown in FIG. 4 also differed from Examples I and II in the weight proportions of molybdenum and ferroboron. By using 60 Wt.% molybdenum and 40 Wt.% of the preferred ferroboron the morphology of this example was deemed to be the best of the five alloy examples, with about 78 Vol.% primary borides. From FIG. 4 note that the grains 20 of the primary boride phase 12 are equiaxed and desirably more uniform in appearance, being generally in a range of about 10 to 30 microns in size and having an interparticle spacing in a range of about 0 to 10 microns. Knoop hardness readings of the Example III sample at a 500 gram load varied from about 1580 to 1750 Kg/mm$^2$ and averaged about 1700 Kg/mm$^2$.

EXAMPLE IV

Figure 5:
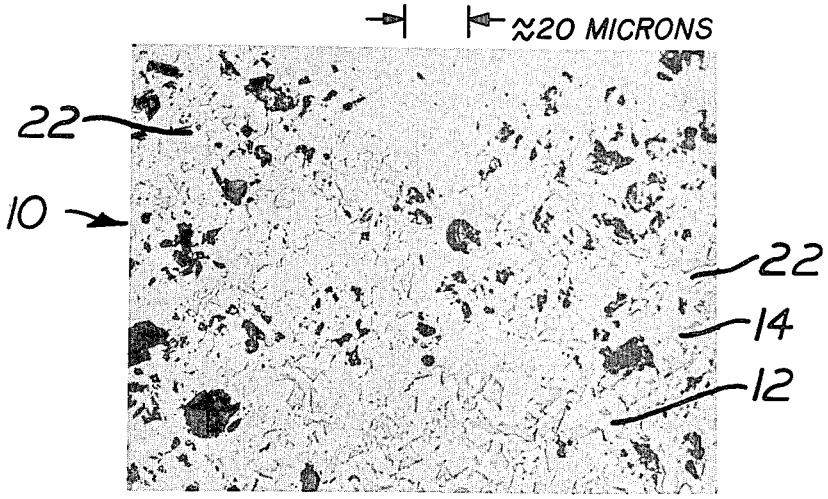
FIG. 5 is a photomicrograph of the alloy in Example IV of the present invention.

Referring now to FIG. 5, it will be noted that the morphology of Example IV alloy shows a marked change to a more lenticular shape of the grains 22 of the primary boride phase 12, as opposed to the more granular or equiaxed shape of the grains 16, 18, and 20 of Examples I–III. The Example IV alloy differed by a decrease in the molybdenum content to 50 Wt.% and an increase in the preferred ferroboron content to 50 Wt.%. Approximately 60 Vol.% of the primary boride phase 12 was obtained, and Knoop hardness readings at a 500 gram load varied from about 1650 to 1810 Kg/mm$^2$ and averaged about 1730 Kg/mm$^2$. In the Example IV embodiment there are longer, irregular networks of the primary boride phase of finer size. This represents a transition morphology toward a more iron and boride composition. The irregular grains 22 are generally judged to have a latch thinkness range of about 4 to 10 microns, with an interparticle spacing in a range of about 0 to 20 microns.

EXAMPLE V

Figure 6:
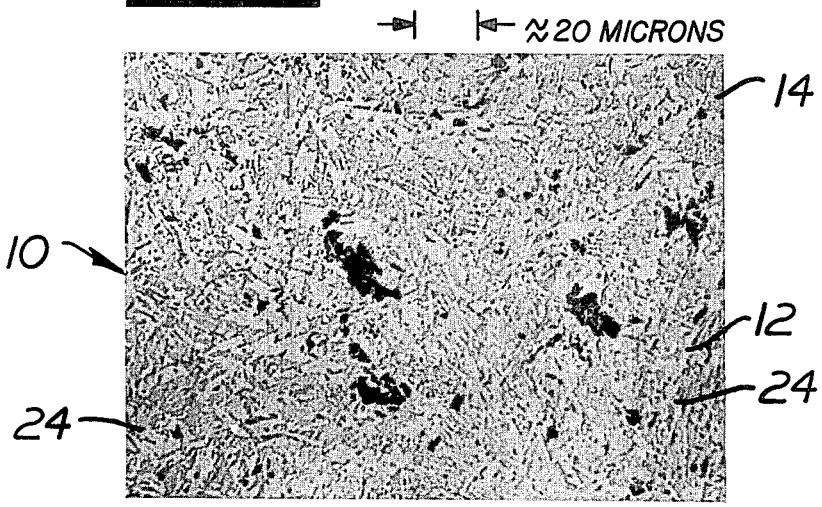
FIG. 6 is a photomicrograph of the alloy in Example V of the present invention.

FIG. 6 shows the Example V composition of 40 Wt.% molybdenum and 60 Wt.% of the preferred ferroboron, and the still further lenticular trend of the morphology away from the preferred equiaxed grain shape. The finer grains 24 of the primary boride have a lath thickness range of about 2 to 8 microns and an interparticle spacing in a range of about 0 to 10 microns. An undesirably low 46 Vol.% of the primary boride phase 12 was obtained.

In summarizing, the Example I (FIG. 2) composition shows that any further decrease in the preferred ferroboron constituent results in an undesirable increase in the softer iron-molybdenum in iron matrix phase 14 with a marked decrease in resistance to abrasive wear. The Example IV (FIG. 5) composition shows that any further increase in the ferroboron constituent will result in an undesirable increase in the iron-boron in iron matrix phase and that the lenticular shape of the boride alloy grains will become more pronounced to further decrease water resistance. Since the Example II (FIG. 3) composition represents the highest desirable amount of primary borides at 95 Vol.%, the preferred broad range of the primary boride phase 12 is preferably established between about 60 to 95 Vol.% of the total alloy. The examples further indicate that the most desirable range of the primary boride phase is between about 70 to 90 Vol.% of the total alloy. Any increase in the amount of boron, for example, above the preferred 25 Wt.% boron ferroboron material, will shift the characteristic curve 6 to the left when viewing FIG. 1. Any decrease will move the curve to the right.

As a result, the preferred broad range molybdenum-iron boride alloy 10 includes molybdenum in the range of about 50 to 77 Wt.%, iron in the range of about 17 to 38 Wt.%, and boron in the range of about 5 to 13 Wt.% of the total alloy. Residual impurities which are normally present in commercial quantities of the molybdenum and ferroboron constituents, such as silicon, aluminum, phosphorus, sluphur, and the like, are preferably individually limited to levels below 2 Wt.%. Collectively, such residual impurities should be limited to less than 5 Wt.%. Such alloy will have an average Knoop hardness level of above 1550 Kg/mm$^2$ using a 500 gram load.

Because of the change to the harder form of the matrix phase 14 above 32 Wt.% ferroboron to iron-boron in iron as mentioned previously, the most desirable range of the boride alloy 10 includes molybdenum in the range of about 55 to 65 Wt.%, iron in the range of about 26 to 34 Wt.%, and boron in the range of about 8 to 12 Wt.%. The amount of iron in the most desirable range is thereby limited to less than about 34 Wt.%, which advantageously restricts or controls the amount of this relatively softer constituent.

While I have set forth above the preferred broad range and most desirable range compositions of the molybdenum-iron boride alloy 10, I also contemplate that a limited degree of substitution can take place within the material group known as refractory transition elements without destroying the basic construction and accompanying advantages of the boride alloy 10. Specifically, I believe that one or more of the refractory transition elements selected from the group consisting of chromium, tungsten, vanadium, columbium, tantalum, titanium, zirconium, and hafnium can be controllably substituted for a limited portion of the refractory transition element molybdenum in the boride alloy 10. Preferably, such additional element or elements should be collectively limited to less than 10 Wt.% of the total amount of molybdenum present in the boride alloy 10 and less than 5 Wt.% of the total alloy. In other words, the alloy 10 of the present invention can consist primarily, but not essentially, of molybdenum, iron, and boron since a preselected relatively limited fraction of the molybdenum can be replaced by a substantially equivalent collective amount of one or more of the remaining eight refractory transition elements. Thus, any one of the eight refractory transition elements can also be present in a range of about 0 to 4.9 Wt.%. If chromium is present in an amount of 4.9 Wt.%, for example, then the preferred broad range of molybdenum in the alloy 10 would be lowered from about 50 to 77 Wt.% to about 45 to 72 Wt.%.

INDUSTRIAL APPLICABILITY

The molybdenum-iron boride alloy 10 of the present invention finds particular usefulness in the environment of a ground engaging tool of an earthmoving machine, for example. Specifically, the alloy 10 can be crushed into particles and the particles subsequently bound together by a suitable matrix to form a composite wear-resistant material. The iron-boron matrix composition disclosed in U.S. Pat. No. 4,066,422 which issued Jan. 3, 1978 to L. J. Moen, for example, can be used to closely embrace and contain particles of the molybdenum-iron boride alloy 10 of the present invention. That matrix composition is economical, while also being relatively hard and resistant to shock in use, and is incorporated herein by reference. Such composite wear-resistant coating, and can be formed into a machine tool insert, a bearing, or the like, so that it is apparent that a multiplicity of uses is contemplated.

Other aspects, objects, and advantages of this invention can be obtained from a study of the drawings, the disclosure, and the appended claims.

What is claimed is:

1. A wear-resistant, molybdenum-iron boride alloy (10), comprising:

a microstructure of a primary boride phase (12) and a matrix phase (14);

said primary boride phase (12) comprising molybdenum alloyed with iron and boron; and said matrix phase (14) comprising one of iron-boron in iron and iron-molybdenum in iron, said matrix phase (14) having a hardness less than that of said primary boride phase (12).

2. The alloy of claim 1 wherein said primary boride phase (12) is present in a range of about 60 to 95 Vol.% of the total alloy.

3. The alloy of claim 1 wherein said primary boride phase (12) is present in a range of about 70 to 90 Vol.% of the total alloy.

4. The alloy of claim 1 including a plurality of residual impurities individually limited to levels below 2 Wt.%.

5. The alloy of claim 1 wherein molybdenum is in a range of about 50 to 77 Wt.% of the total alloy.

6. The alloy of claim 1 wherein iron is in a range of about 17 to 38 Wt.% of the total alloy.

7. The alloy of claim 1 wherein boron is in a range of about 5 to 13 Wt.% of the total alloy.

8. The alloy of claim 1 wherein molybdenum is in a range of about 55 to 65 Wt.% of the total alloy.

9. The alloy of claim 1 wherein iron is in a range of about 26 to 34 Wt.% of the total alloy.

10. The alloy of claim 1 wherein boron is in a range of about 8 to 12 Wt.% of the total alloy.

11. The alloy of claim 1 wherein molybdenum is in a range of about 50 to 77 Wt.%, iron is in a range of about 17 to 38 Wt.%, and boron is in a range of about 5 to 13 Wt.%.

12. The alloy of claim 1 wherein molybdenum is in a range of about 55 to 65 Wt.%, iron is in a range of about 26 to 34 Wt.%, and boron is in a range of about 8 to 12 Wt.%.

13. The alloy of claim 1 wherein said primary boride phase (12) is of the form $Mo_2FeB_2$.

14. The alloy of claim 1 wherein said alloy has an average Knoop hardness level of above 1550 $Kg/mm^2$ at 500 gram load.

15. The alloy of claim 1 wherein said primary boride phase (12) consists essentially of grains of equiaxed shape.

16. The alloy of claim 1 wherein said matrix phase (14) is iron-boron in iron.

17. The alloy of claim 1 in particulate form in a matrix and providing a composite wear-resistant material.

18. The alloy of claim 17 wherein said composite wear-resistant material is on a ground engaging tool.

19. A wear-resistant, molybdenum-iron boride alloy (10), comprising:

molybdenum in a range of about 50 to 77 Wt.%; iron in a range of about 17 to 38 Wt.%; boron in a range of about 5 to 13 Wt.%; and wherein a primary boride phase (12) and a matrix phase (14) are provided, said primary boride phase (12) containing molybdenum and being harder than said matrix phase (14).

20. The alloy of claim 19 wherein said primary boride phase (12) consists primarily of molybdenum alloyed with iron and boron in granular shape.

21. The alloy of claim 19 wherein said primary boride phase (12) is formed in a range of about 70 to 90 Vol.% of the total alloy.

22. The alloy of claim 19 wherein said primary boride phase (12) has grains (16,18,20) of equiaxed shape of the form $Mo_2FeB_2$.

23. A wear-resistant, molybdenum-iron boride alloy (10), comprising:

molybdenum in a range of about 50 to 77 Wt.%;
iron in a range of about 17 to 38 Wt.%;
boron in a range of about 5 to 13 Wt.%;
chromium in a range of about 0 to 4.9 Wt.%;
titanium in a range of about 0 to 4.9 Wt.%;
vanadium in a range of about 0 to 4.9 Wt.%;
columbium in a range of about 0 to 4.9 Wt.%;
zirconium in a range of about 0 to 4.9 Wt.%;
hafnium in a range of about 0 to 4.9 Wt.%;
tantalum in a range of about 0 to 4.9 Wt.%;
tungsten in a range of about 0 to 4.9 Wt.%; and wherein the alloy includes a primary boride phase (12) and a matrix phase (14), said primary boride phase being between about 70 to 90 Vol.% of the total alloy.

24. A wear-resistant, molybdenum-iron boride alloy (10), comprising:

a microstructure containing a primary boride phase (12) and a matrix phase (14);

said primary boride phase (12) consisting primarily, but not essentially of molybdenum alloyed with iron and boron and having a microstructure characterized primarily by grains of equiaxed form; and said matrix phase (14) consisting primarily, but not essentially of one of iron-boron in iron and iron-molybdenum in iron.

25. A wear-resistant, molybdenum-iron boride alloy (10), comprising:

70 to 90 Vol.% of a primary boride phase (12) characterized primarily, but not essentially of molybdenum alloyed with iron and boron in equiaxed grain form; and 10 to 30 Vol.% of a matrix phase (14) characterized primarily, but not essentially of one of iron-boron in iron and iron-molybdenum in iron.

26. A method of making a wear-resistant, molybdenum-iron boride alloy (10), comprising:

(a) mixing a plurality of ferroboron particles and a plurality of molybdenum particles and forming a mix at a preselected ratio by weight;

(b) compressing the mix at a preselected pressure level into an article of preselected shape;

(c) sintering the article at a temperature sufficient for controlled formation of a liquid phase;

(d) holding said temperature for a preselected period of time sufficient to effect a substantially complete reaction and a substantially densified article; and (e) cooling the substantially densified article to provide an alloy (10) having a primary boride phase (12) in a matrix phase (14).

27. The method of claim 26 wherein step (c) includes sintering in a substantially inert atmosphere.

28. The method of claim 26 wherein step (c) includes sintering under less than atmospheric pressure.

29. The method of claim 26 wherein the preselected pressure level of step (b) is about 345 MPa.

30. The method of claim 26 wherein the temperature of step (c) is about 1600° C.

31. The method of claim 26 wherein the period of time of step (d) is about ten minutes.

* * * * *